United States Patent [19]

Escallon et al.

[11] 4,341,103

[45] Jul. 27, 1982

[54] SPIN-NECKER FLANGER FOR BEVERAGE CONTAINERS

[75] Inventors: Eduardo C. Escallon, Muncie, Ind.; Paul S. Marsh, East Lansing, Mich.

[73] Assignee: Ball Corporation, Muncie, Ind.

[21] Appl. No.: 183,868

[22] Filed: Sep. 4, 1980

[51] Int. Cl.[3] ..... B21D 19/12

[52] U.S. Cl. ..... 72/70; 72/91; 72/105

[58] Field of Search ..... 72/70, 91, 94, 105, 72/106; 113/120 V, 120 AA

[56] References Cited

U.S. PATENT DOCUMENTS

| | | | |
|---|---|---|---|
| 1,950,154 | 3/1934 | Rosenberg et al. | 72/70 |
| 3,688,538 | 9/1972 | Hoyne | 113/120 AA |
| 3,754,424 | 8/1973 | Costanzo | 72/105 |
| 3,782,314 | 1/1974 | Franek et al. | 113/120 AA |
| 3,782,315 | 1/1974 | Passenheim | 113/120 AA |
| 3,874,209 | 4/1975 | Maiorino | 72/91 |

*Primary Examiner*—Lowell A. Larson
*Attorney, Agent, or Firm*—Gilbert E. Alberding

[57] ABSTRACT

A method and apparatus for beading canbodies, or like hollow members having at least one terminal end edge, a first annular end portion adjacent said terminal end edge, a second annular end portion adjacent said first annular end portion and a third annular end portion adjacent said second annular end portion. An inner forming means is placed within the canbody, said inner forming means having an annular inner forming surface in juxtaposition to said first annular end portion, an arcuate concave inner forming surface extending from said annular inner forming surface and in juxtaposition to said second annular end portion and a cylindrical inner support surface extending axially inward from said arcuate concave inner forming surface and in juxtaposition to said third annular end portion. An outer forming means is placed around the canbody, said outer forming means having an annular outer forming surface compatibly shaped and in radial alignment with said arcuate concave inner forming surface. Preferably the first annular end portion of the hollow member is first outwardly deformed to an increased diameter by progressively, over a sector of the circumference of the member, engaging and deforming the first annular end portion outwardly a predetermined distance by radial movement of the inner forming means, while supportively engaging, over a major portion of the sector being so deformed, the second annular end portion by opposing radial movement of the outer forming means.

2 Claims, 8 Drawing Figures

SPIN-NECKER FLANGER FOR BEVERAGE CONTAINERS

TECHNICAL FIELD

This invention relates to the art of can manufacturing and more particularly, to the beading or necking and flanging of the open-end portion of canbodies. Although this invention is particularly applicable to canbodies and will be described with reference thereto, it is to be appreciated that the invention has broader application and may be used for beading other hollow cylindrical bodies that are subject to plastic deformation such as conduit, pipe or the like.

BACKGROUND ART

The open end of canbodies is commonly reduced in diameter and flanged. The flange facilitates attaching a closure to the end and the reduction in diameter allows using a smaller closure thereby saving material. Furthermore, reducing the diameter does not substantially decrease the volume of the can.

The beading of cans in a production line can manufacturing facility generally requires a multiple step operation. One or more reductions in diameter are achieved by forcing the open end of the can into an inwardly tapered necking die until the appropriate amount of plastic deformation occurs. The terminal edge of the can is then outwardly flanged to an increased diameter.

A major source of defective cans, the split flange, often results from this necking and flanging operation. It is to be appreciated that in the formation of the canbody a substantial amount of strain hardening takes place. When the end is then reduced in diameter, the ductility of the metal is further reduced and wrinkling or buckling may occur. During the following flanging operation split flanges may occur due to the high tensile forces exerted circumferentially on the strain hardened neck by the flanging tool and due to existing wrinkles in the neck which may act as stress concentrators.

One method of reducing the amount of work that the flanged end is subjected to is a process that will broadly be referred to herein as "spin-necking." In spin-necking the canbody is rotated while inner and outer forming rolls neck and flange the end portion. Unlike a conventional production line operation where the entire end portion of the can is reduced in diameter (necked) and the terminal edge is then flanged to an increased diameter, in spin-necking the terminal edge is supported by the inner forming roll and flanged from its original diameter without first being reduced in diameter. Therefore, the work involved in reducing the terminal edge by necking and then flanging back to the original diameter is avoided. This greatly reduces the risk of split flanges, both at the can manufacturing facility and at the beverage filling facility where the closure is applied.

Various approaches to spin-necking are taught by U.S. Pat. No. 3,967,488 to Hasselbeck et al., U.S. Pat. No. 4,176,536 to Parknin et al., and U.S. Pat. No. 4,070,888 to Laszlo. Laszlo discloses an apparatus and method for spin-necking canbodies which utilize two independent annular forming surfaces which move in opposite axial directions during the necking process. Both Hasselbeck and Parknin utilize inner support tooling which extends over a major portion of the length of the canbody. Hasselbeck uses an internal gripping means which presents an uninterrupted surface to the inner peripheral surface of the can. Although such a gripping means reduces the chance of wrinkling and buckling it also poses substantial practical problems in a production line situation. Parknin teaches a highly complex apparatus that has some of the drawbacks of Hasselbeck due to the large internal tooling used.

Generally, in a production line, cans which are to be beaded have already had a protective coating applied to their interior surfaces. This coating protects the contents of the can against the absorption of a metallic taste and more importantly, with some corrosive soft drink beverages, protects the metal can from the corrosive influence of the beverage. It is therefore imperative that the integrity of this coating be preserved throughout the beading operation. Also, in many situations, no further cleaning of the canbody will be done after necking and flanging and prior to filling. Therefore, any contact with the interior surface of the canbody will increase the risk of contamination with foreign matter which may be carried by the contacting member. Hence, large internal tooling in a necking operation in undesirable for contact with the interior surface of the canbody should be avoided to the greatest extent possible.

Furthermore, positive gripping means, such as those taught by Hasselbeck in the aforementioned patent, are generally incapable of handling canbodies having even small variations in diameter. The gripping means must be designed for a single size of can within very low tolerances. If a can is too large, the positive gripping means is ineffective. If the can is too small, damage to the can may occur when the gripping means is fully expanded. In either case, there is also a greater chance of damage to the interior protective coating. Unfortunately, in a can manufacturing facility, due to variations in metal stock, temperature and tool wear, a relatively wide range of diameters are produced. To decrease the tolerance range within which cans have heretofore been acceptable would be prohibitively expensive. For the above and other reasons, the search for an improved method of spin-necking has continued.

SUMMARY OF THE INVENTION

In accordance with the broader aspects of the present invention there is provided a method and apparatus for first, increasing the diameter of a canbody by progressively, over a sector of the circumference, deforming a first annular end portion of the canbody outwardly a predetermined distance while supporting an adjacent second annular end portion over a major part of said sector and circumferentially changing said sector under deformation and support; and second, reducing the diameter of the canbody by progressively, over a sector of the circumference, deforming said second annular end portion inwardly a predetermined distance while, supporting over a major part of said sector, said first annular end portion and a third annular end portion which is axially adjacent to and inwardly located to said second annular end portion, and circumferentially changing said sector under deformation and support.

More particularly, inner and outer rotatably mounted forming means are respectively placed within and around the canbody. The inner forming means is provided with an annular inner forming surface located in juxtaposition to said first annular end portion. The outer forming means is provided with an annular outer forming surface in juxtaposition to said second annular end portion. While rotating the canbody, the inner and outer forming means are translated in opposite radial directions until the annular outer forming surface is in supportive engagement with a sector of the circumference of the second annular end portion while the annular inner forming surface is translated through the plane of the canbody thereby deforming said sector of the first annular end portion outwardly into an increased diameter flange.

To neck a canbody flanged by the above operation, an inner forming means is provided which has the above-mentioned annular inner forming surface adjacent the first annular end portion of the canbody, a concave arcuate forming surface extending from said annular inner forming surface and in juxtaposition to said second annular end portion, and a cylindrical support surface of a substantial axial length extending axially inwardly from said concave arcuate surface and in juxtaposition to a third annular end portion of the canbody.

The outer forming means is moved radially inwardly deforming a sector of the second annular end portion inwardly to a decreased diameter while the inner forming means supportively engages, over a major portion of said sector, said first and third annular end portions. The working sector is circumferentially changed while continuous radial movement of the outer forming means takes place until the second annular end portion is tightly squeezed between the inner arcuate concave forming surface and the outer annular forming surface.

In accordance with one arrangement, the inner forming means is a rotatably mounted inner mandrel having an outer peripheral surface which is provided with a circumferential groove. Said groove defines an arcuate concave forming surface beginning at a first zone and ending at a second zone wherein said first zone is of a greater diameter than said second zone. For support of the canbody, a substantially cylindrical support surface of said second diameter is integrally connected to the end of said arcuate concave forming surface. The inner mandrel is positioned within a canbody such that said first zone is adjacent the terminal edge of the canbody and the second zone with the integrally connected cylindrical support surface is within the canbody.

The outer forming means is a hollow, cylindrically shaped, rotatably mounted, outer mandrel having an arcuate convex rib on the inner peripheral surface thereof and is positioned over the canbody such that said groove will receive said rib and wherein said groove and said rib are compatibly shaped.

A power means is provided to rotate the canbody about its longitudinal axis. Alternatively, the canbody may be rotatably mounted and one of the mandrels may be rotated by said power means. Where the can is to be powered, it is preferrable to engage the exterior surface of the can, such as the bottom, to avoid damage to the interior surface and possible contamination.

Independent mounting means are provided allowing movement of said mandrels, in opposite directions, along a perpendicular from the longitudinal axis of rotation of the canbody.

The mandrels are initially positioned coaxially with the longitudinal axis of the canbody. A first actuating means moves the inner and outer mandrels in opposite directions to bear gently against the canbody while the canbody is rotating. A second actuating means further moves the inner mandrel against the canbody engaging the inner peripheral surface of the canbody along the first annular end portion and deforming the first annular end portion outwardly. This results in an outwardly progressive deformation of a sector of the first annular end portion from a point of greatest deformation which tapers in both directions over the circumference of the canbody to points of substantially no deformation. A major portion of this sector is supported by the rib on the outer mandrel which is brought, by the deformation, into engagement with the outer peripheral surface of the canbody along the second annular end portion. Upon being rotated 360 degrees through the deformation and support sectors, the first annular end portion is formed into an outwardly extending flange. Usually the desired flange diameter can be achieved in one complete rotation of the canbody; however, a greater diameter flange may be formed by repeating the above steps of deforming, supporting and rotating. The outer peripheral surface of the inner mandrel should be appropriately shaped such that upon completion of the flanging operation the substantially cylindrical support surface of the inner mandrel will engage and support the inner peripheral surface of the canbody along a sector of the third annular end portion.

Formation of this outwardly extending flange over the first annular end portion of the canbody reinforces the second annular end portion of said canbody against buckling and assists in the prevention of wrinkles during the deformation experienced by said second annular end portion in the following necking operation. The mechanical simplicity with which the present invention may be practiced is in part attributable to this reinforcing step. As will become apparent from the following description, unlike the above cited prior art spin-necking devices, no axially or radially moving inner forming surfaces are employed by the present invention during the necking operation.

A third actuating means then moves the outer mandrel in an opposite direction to which the inner mandrel was translated by the second operating means. The rib on the outer mandrel contacts a sector of the outer peripheral surface of the canbody along the second annular end portion and deforms said surface inwardly into contact with the inner mandrel along the first and third annular end portions. A sector of the canbody is thereby progressively inwardly deformed by said outer mandrel and supported by said inner mandrel. The size of said sector is determined by the deformation or movement of the outer mandrel and the rotational speed of said canbody. As more than one revolution is generally required to plastically deform the second annular end portion to the desired neck diameter, the movement of the outer mandrel is best described in terms of distance moved per revolution of the canbody. The greater the distance moved, the larger the sector deformed and supported.

Furthermore, the size of the sector is dependent on the diameter of the canbody which is being worked. In necking a canbody from a 2.50 inch diameter to a 2.25 diameter, the size of the working sector decreases with each revolution from about 80 degrees initially to about 20 degrees at the final reduced diameter. In flanging, the working sector increases as the flange diameter increases.

Usually a canbody will require between about two to ten revolutions to create a standard neck of between about a 0.1 to a 0.25 inch reduction in diameter. In the final forming step, the compatibly shaped inner and outer mandrels are positively squeezed together while the canbody is rotated through 360 degrees. This simulates essentially closed die conditions and gives great control over the final shape of the neck and flange. Once the neck is formed, a fourth actuating means moves the inner and outer mandrels back to their initial positions coaxial with the longitudinal axis of the canbody and the finished canbody is then removed.

From the above description of the invention it should be apparent that the present invention operates by positive deformation over a sector of an annular end portion while positively engaging and supporting, over a major part of said sector, an adjacent annular end portion or portions. Neither flexible biasing or loading means is necessary directly behind the end portion being deformed as is required by Parknin et al and Hasselbeck in the above-mentioned patents, nor are axially moveable inner forming surfaces as required by Laszlo, thereby allowing use of a much simpler apparatus with considerably fewer moving parts and resulting higher mechanical reliability and lesser maintenance requirements.

Accordingly, it is an object of this invention to provide a simple method and apparatus for the beading of canbodies with a minimum of contact to the internal surface of the canbody.

It is a further object of the present invention to provide a means of necking a hollow cylindrical metal body without the necessity of directly supporting the area being necked.

It is a further object of this invention to provide a method of flanging cans without necking.

It is a further object of the present invention to provide greater control over the strain rates and dimensional characteristics in a necking and flanging operation by deforming and supporting the canbody over a large sector of its circumference and performing a final shaping operation under essentially closed die conditions.

DETAILED DESCRIPTION OF THE INVENTION

Figure 1:
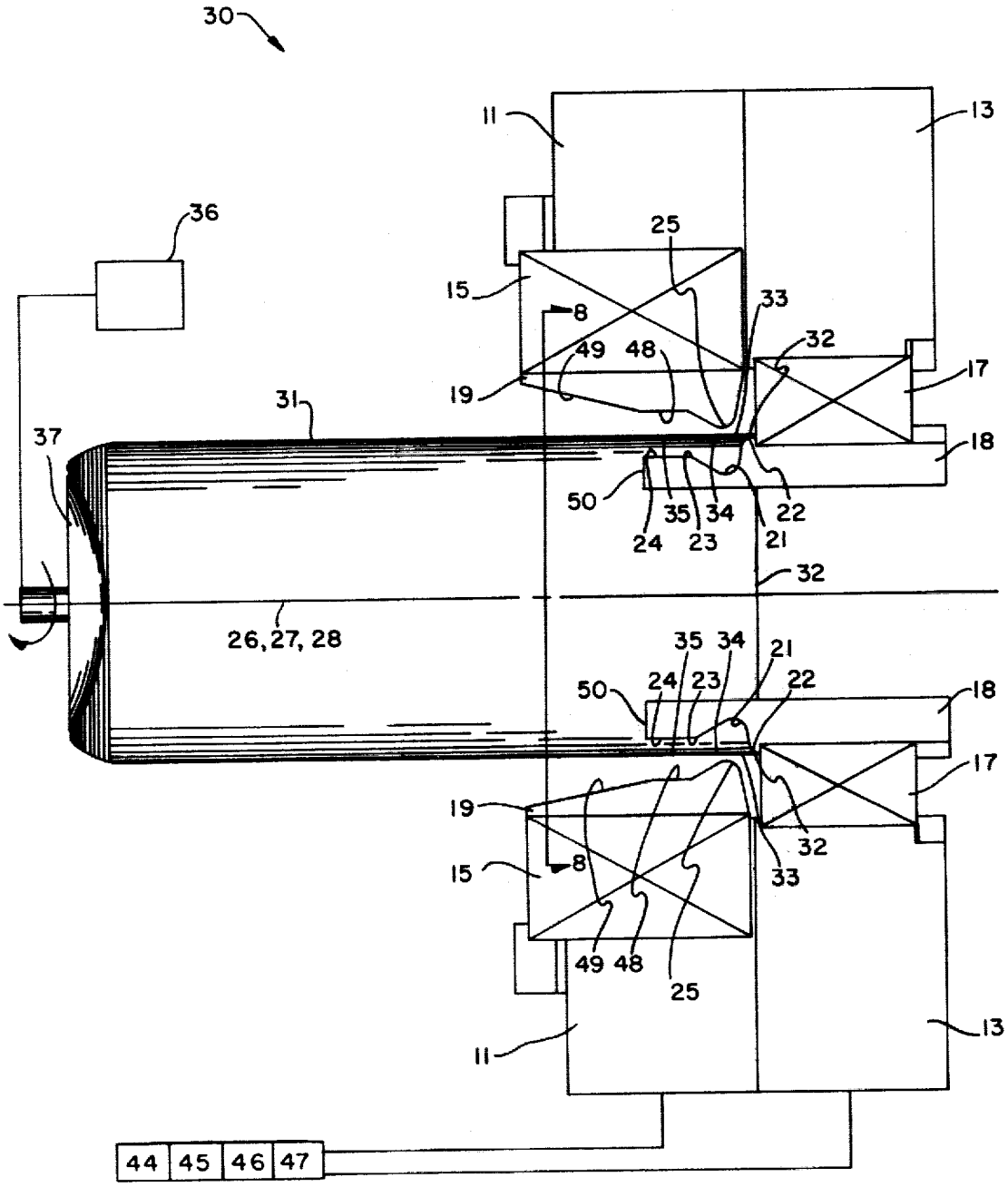
FIG. 1 is a cross-sectional view of the necker flanger apparatus constructed in accordance with the present invention and having an unworked canbody in place.

While this invention is susceptible of embodiment in many different forms, there is shown in the drawings and will herein be described in detail, one specific embodiment, with the understanding that the present disclosure is to be considered as an exemplification of the principles of the invention and is not intended to limit the invention to the embodiment illustrated.

Referring to FIG. 1, the necker-flanger apparatus is generally referenced by numeral 30. An outer mandrel 19 is rotatably mounted in bearing module 15 which in turn is mounted in moveable bearing block 11. Likewise, inner mandrel 18 is rotatably mounted in bearing module 17 which is mounted in bearing block 13. Bearing blocks 11 and 13 are suitably constrained to independent vertical movement which can be imported by any conventional means such as pneumatic cylinders or screw drives, or cams. Apparatus for actuating such vertical movement is schematically shown and referenced as 44 through 47.

Unnecked canbody 31 is shown in position to begin the necking and flanging operation. Said canbody has a terminal edge 32, a first annular end portion 33, a second annular end portion 34 and a third annular end portion 35, said annular end portions having a wall thickness of between about 0.002 inches and about 0.010 inches.

The outer peripheral surface of inner mandrel 18 has an arcuate concave surface 21 thereon. Said surface begins at a first zone 22, of a first diameter, and ends at a second zone 23, of a second diameter, defining a circumferential groove around the inner mandrel. A substantially cylindrical shaped support surface, 24, of said second diameter, is integrally connected to said arcuate concave surface.

Outer mandrel 19 has an arcuate convex surface 25 on the inner peripheral surface thereof. Said arcuate convex surface defines a circumferential rib around the inner peripheral surface of the outer mandrel, said rib being compatibly shaped to receive said groove.

An outer cylindrical support surface 48, is integrally connected to and extends axially inward from said rib, terminating at a radially outwardly sloped smooth guiding surface 49. Outer cylindrical precise dimensional characteristics to the beaded end during the final forming step. Guiding surface 49 allows for easy placement of a canbody in the necker-flanger.

Figure 8:
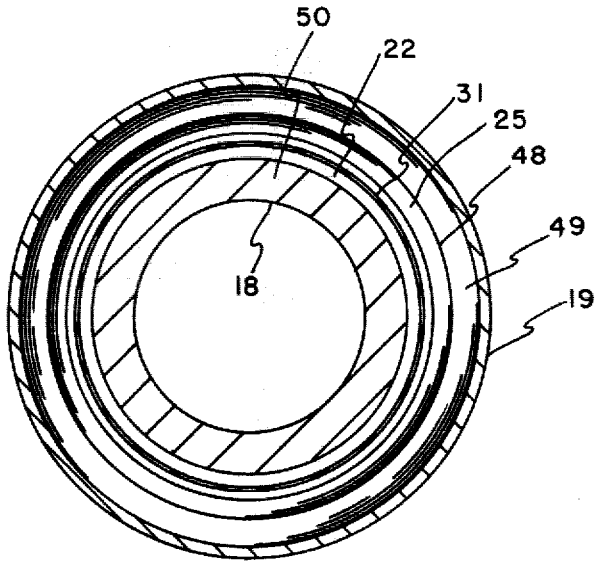
FIG. 8 is the cross-sectional view of line 8—8 in FIG. 1 better illustrating the shape of the mandrels.

An end view of the inner and outer mandrels with a canbody in place is illustrated in the sectional view of FIG. 8. This view is taken along line 8—8 of FIG. 1. Inner mandrel end surface 50 is shown as is the radial relationship between the inner and outer mandrels and the canbody in the beginning positions of FIG. 1.

Bearing module 17 also functions as a can stop. When the terminal edge 32 of canbody 31 is in contact with the bearing module the canbody is in the correct axial position to begin the necking and flanging operation.

A canbody rotating and restraining means 37 holds the canbody against bearing block 17. A conventional power means, 36, drives rotating and restraining means 37. A variety of other means may be used to rotate and correctly determine the axial position of the canbody. Either mandrel may be powered rather than the canbody with equally satisfactory results.

To further reduce the incidence of defective flanges, an abrasive finish or roughened faceplate (not shown)

may be placed on the can stop along the surface, 42 (FIG. 5), which will come into contact with terminal edge 32 of canbody 31. If the can stop is rotatably mounted, a means (not shown) of momentarily braking the can stop should also be provided. The initial rotation of the canbody would then take place against this stationary abrasive surface thereby smoothing terminal edge 32 of notches or cracks which often result from the prior canbody forming and trimming operation. This would eliminate such cracks or notches from acting as stress concentrators in the necking and flanging operation.

Figure 2:
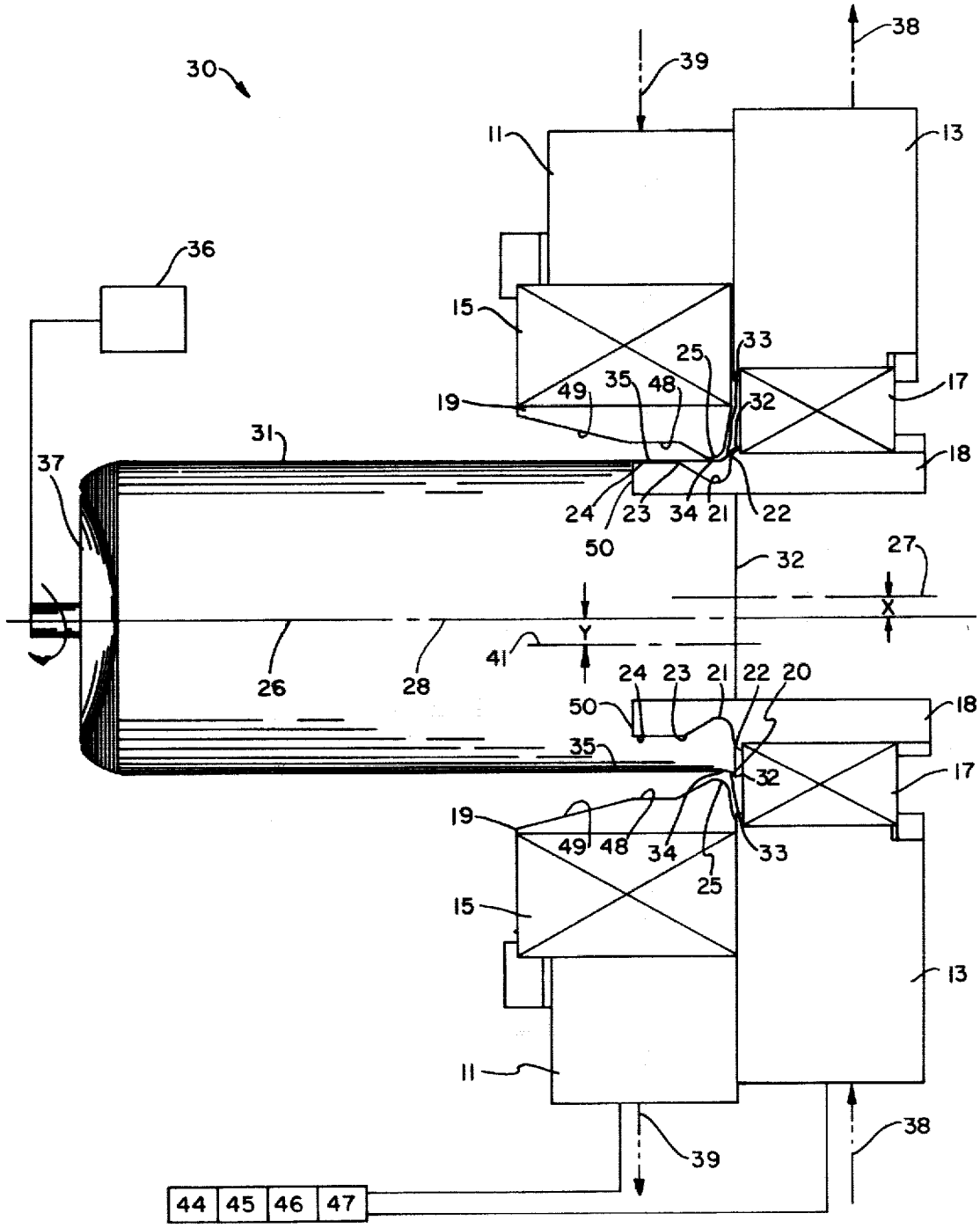
FIG. 2 is a cross-sectional view of the necker-flanger illustrating the radial movement of the inner mandrel for formation of a flange.
Figure 4:
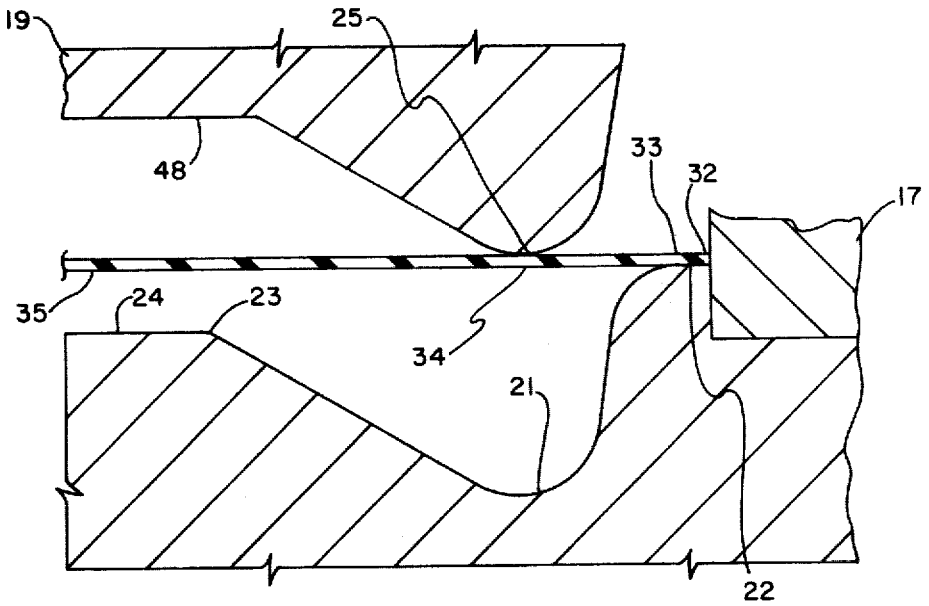
FIG. 4 is an enlarged cross-sectional view of a portion of the inner and outer mandrels in the initial engagement position for flanging canbody.
Figure 5:
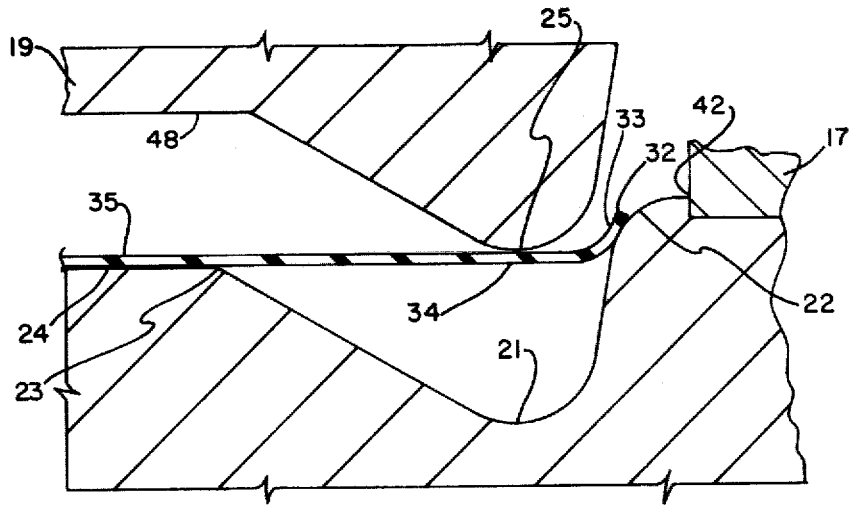
FIG. 5 is an enlarged cross-sectional view of a portion of the inner and outer mandrels in the flanging position of FIG. 2.

To flange the canbody, inner mandrel 18 and outer mandrel 19 initially are positioned coaxially to one another as shown in FIG. 1. The mandrels are then moved in opposite radial directions into contact with the canbody by first actuating means, 44, as shown in the enlarged view of FIG. 4. While rotating the canbody, the inner mandrel is further moved in the radial direction of arrow 38 a distance of X by second actuating means 45. Distance X is indicated in FIG. 2 between longitudinal axis 27 of the inner mandrel and longitudinal axis 26 of the canbody. Terminal edge 32 and first end portion 33 are thereby progressively, over a sector of the circumference of the canbody, deformed outwardly while the second end portion 34 is supported by circumferential rib 25 over a major portion of such sector as best shown in FIG. 5. The flange, 20, may be increased in diameter by continuing to move the inner mandrel in the radial direction of arrow 38 while rotating the canbody until the desired diameter is obtained.

Figure 6:
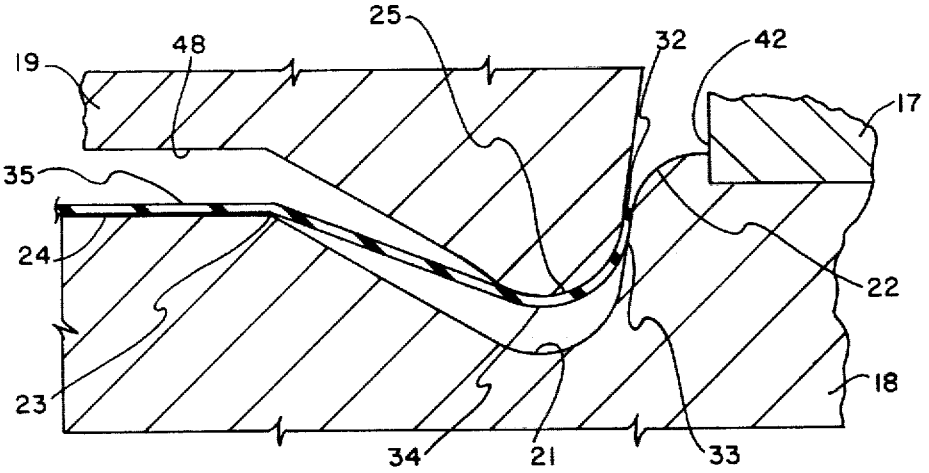
FIG. 6 is an enlarged cross-sectional view of a portion of the inner and outer mandrels midway through the necking process.

A third actuating means, 46, radially moves outer mandrel 19. Referring to FIG. 2 and enlarged view FIG. 6, a partially completed neck is formed by moving outer mandrel 19 in the direction of arrow 39 a distance of Y as indicated between the projected longitudinal axis 41 of the outer mandrel, if so moved, and longitudinal axis 26 of the canbody. As radial movement Y takes place, the canbody is rotated through 360 degrees. Rib 25 on outer mandrel 19 thereby engages second end portion 34 and progressively, over a sector of the circumference of the canbody, deforms said second end portion inwardly. Inner mandrel 18 engages and supports the inner peripheral surface of the canbody over a major portion of such sector along first annular end portion 33 and third annular end portion 35. Upon rotating the canbody through 360 degrees, neck 29 is formed. Generally, two to ten rotations of Y movement/rotation will be necessary to form a commercially acceptable neck. In operation, the canbody is rotated and the outer mandrel is moved at a continuous speed that achieves a movement of Y distance per revolution. This results in smoothly attaining the desired deformation sectors rather than abruptly "denting" the canbody.

The maximum magnitude of Y movement/rotation is directly related to the critical buckling load which the canbody material can withstand. Plastic deformation of the canbody to a reduced diameter neck results from the compressive forces placed on the canbody by the inner and outer mandrels. The greater the deformation of the canbody, the greater the compressive forces induced thereon. The compressive forces are highest at the point of greatest deformation and taper off to near zero at the beginning of the deformation sector. If the maximum compressive force exceeds the critical buckling load of the material, wrinkling of the neck will occur resulting in an unusable canbody. It has been observed that, in the present invention, a deformation of greater than about 0.08 inches per revolution will result in buckling and wrinkling of a thin walled canbody. It is preferred to use a maximum deformation of between about 0.01 and 0.025 inches per revolution.

Figure 7:
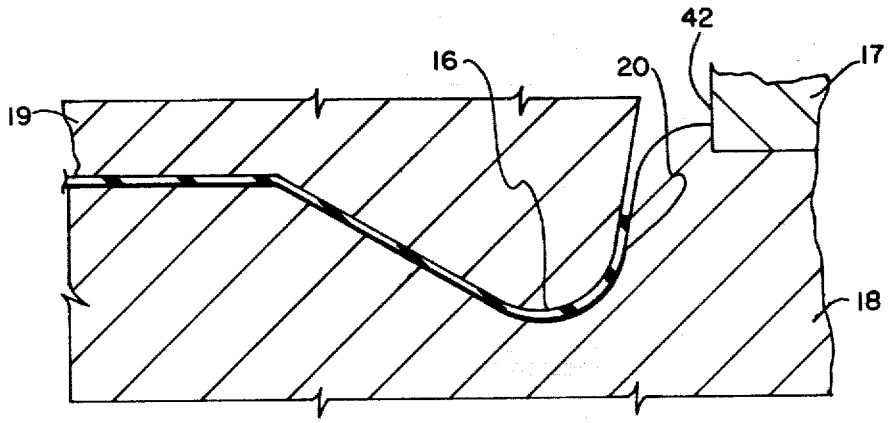
FIG. 7 is an enlarged cross-sectional view of a portion of the inner and outer mandrels in the essentially closed die final forming step.

The rotation of canbody 31 and the movement of outer mandrel 19 in the direction of arrow 39 continue until the mandrels are in a fully tooled position as shown in FIG. 7, wherein the first, second and third end portions of the canbody are tightly squeezed between the inner and outer mandrel. This results in an essentially closed die operation allowing precise dimensional characteristics to be imparted to the end portion in the final forming step.

Figure 3:
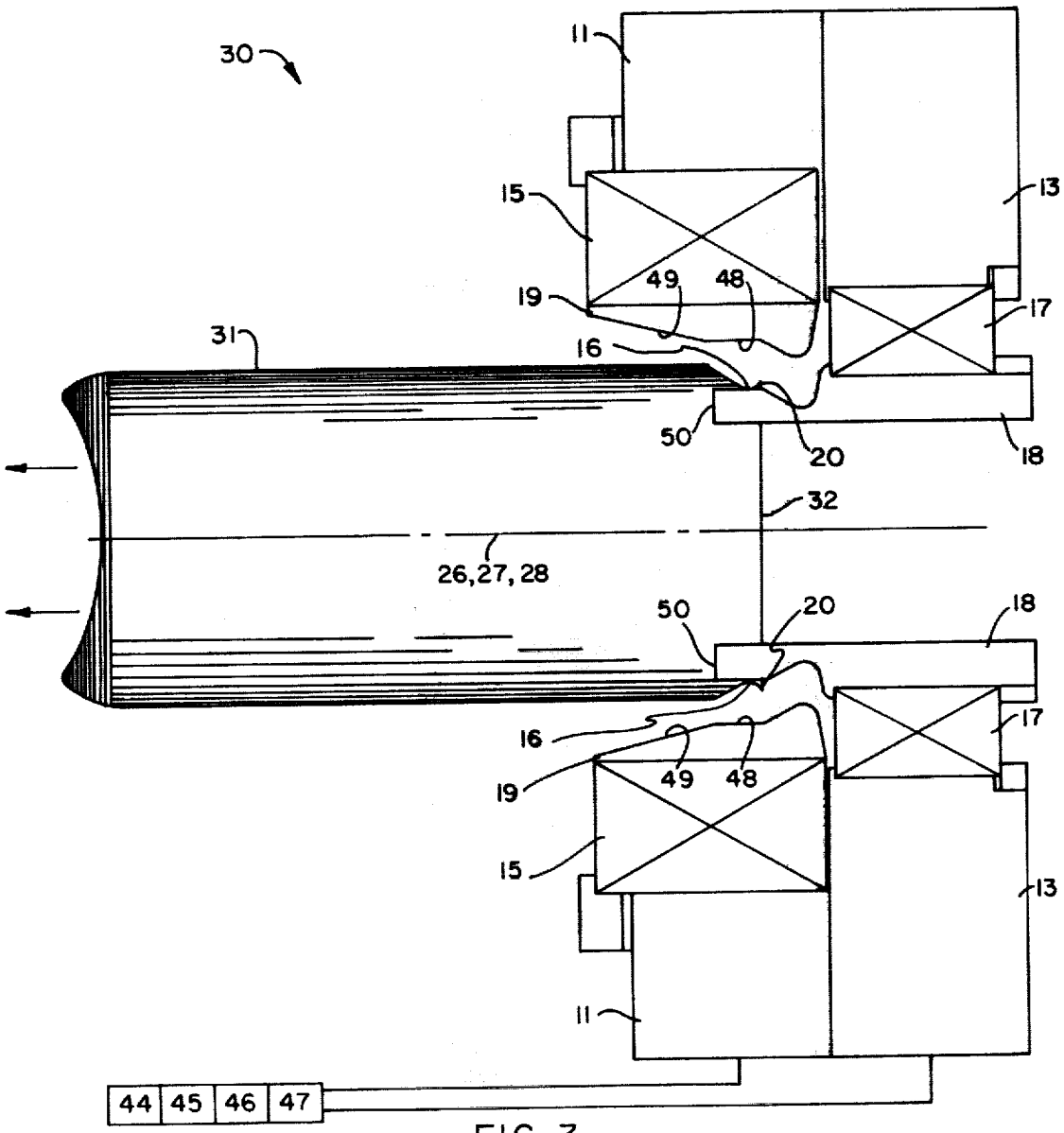
FIG. 3 is a cross-sectional view of the necker-flanger illustrating the final position of the two mandrels for removal of a suitably beaded canbody.

A fourth actuating means, 47, then moves the mandrels back to their initial coaxial position (FIG. 3) and canbody rotating and restraining means 37 is removed allowing access to the finished canbody. The canbody may then be removed by a variety of means including magnetic, grasping, mechanical knock-out or air blow and the spin-necking and flanging apparatus is then ready to receive another canbody.

It should be apparent that it is not necessary to perform a necking and flanging operation with the present invention. Hollow cylindrical bodies may be flanged without necking or, with appropriately shaped inner and outer forming means, necked without flanging.

INDUSTRIAL APPLICATION

The present invention is industrially applicable to the beading or necking and flanging of canbodies or like hollow articles, and more particularly, to minimizing the material requirements of a can closure and facilitating attachment of a closure to a canbody by providing a canbody with a reduced diameter neck and a flange.

We claim:

1. Apparatus for beading the end portion of a substantially cylindrical canbody having a terminal end edge at said end portion, comprising: means for rotating said canbody; a rotatably mounted inner mandrel having a circumferential arcuate groove therein defining a concave arcuate forming surface terminating at spaced apart first and second end zones, said rotatably mounted inner mandrel being capable of engaging said cylindrical canbody over a major portion of a sector of the circumference of said canbody, said first end zone having a first diameter and said second end zone having a second diameter greater than said first diameter, said inner mandrel extending from said first end zone in a substantially cylindrical shape of said first diameter, said inner mandrel being positionable within said canbody with said second end zone located adjacent to the terminal end edge of said canbody and said first end zone located within said canbody, said inner mandrel being provided with a can stop for establishing the correct axial position of said canbody; a rotatably mounted outer mandrel of a hollow cylindrical-like shape having a convex rib on the inner peripheral surface thereof, said convex rib defining an arcuate convex surface which is shaped to receive said groove, said outer mandrel being positionable around said canbody with said rib aligned with said groove; mounting means for independently mounting each of said inner and outer mandrels for movement toward and away from the longitudinal axis of said canbody; and operating means to move said inner and outer mandrels in opposite directions along a plane substantially coextensive with the plane defined by the terminal end edge of said canbody, said operating means comprising a first actuating means to translate said inner and outer mandrels in opposite directions into contact with the peripheral surface of the canbody; a second actuating means to translate said inner mandrel away from the longitudinal axis of said canbody and through the plane of said canbody thereby deforming said terminal end edge and the immediately axial end portion outwardly to an increased diameter; a third actuating means to translate said outer mandrel toward the longitudinal axis of said canbody thereby deforming said end portion inwardly to a decreased diameter; and a fourth actuating means to translate said inner and outer mandrels to positions which are coaxial with said canbody thereby allowing removal of said canbody.

2. Apparatus as described in claim 1 wherein said can stop has an abrasive surface.

* * * * *